United States Patent [19]

Schwartzott

[11] Patent Number: 4,527,346

[45] Date of Patent: Jul. 9, 1985

[54] SHEET MATERIAL STACKING, CONVEYING AND CUTTING METHOD AND APPARATUS

[75] Inventor: John M. Schwartzott, Greensboro, N.C.

[73] Assignee: Macpherson, Inc., Greensboro, N.C.

[21] Appl. No.: 531,882

[22] Filed: Sep. 14, 1983

[51] Int. Cl.[3] ..... D06C 3/00

[52] U.S. Cl. ..... 38/144; 83/100; 83/402; 112/121.15; 112/DIG. 2; 271/97; 271/195; 406/84

[58] Field of Search ..... 83/29, 99, 100, 152, 83/447, 402, 451, 925 CC; 271/195, 97; 406/84; 38/2, 7, 14, 144; 198/428, 955; 112/121.15, DIG. 2, DIG. 3; 269/21

[56] References Cited

U.S. PATENT DOCUMENTS

| | | | |
|---|---|---|---|
| 1,912,724 | 6/1933 | Remington | 271/195 X |
| 3,101,021 | 8/1963 | Johnson | 83/152 X |
| 3,395,943 | 8/1968 | Wilde et al. | 271/195 X |
| 3,559,983 | 2/1971 | Sjostrom | 38/2 X |
| 3,711,038 | 1/1973 | Van Otteren | 406/84 X |
| 3,815,221 | 6/1974 | Pear | 83/29 X |
| 3,975,057 | 8/1976 | Hurd | 271/195 X |

*Primary Examiner*—Werner H. Schroeder
*Assistant Examiner*—Andrew M. Falik
*Attorney, Agent, or Firm*—Charles R. Rhodes; Judith E. Garmon

[57] ABSTRACT

A work table is divided at least into a spreading station and a cutting station, has a flat, substantially smooth upper surface and a plurality of apertures extending through the top of the table for passage of air currents therethrough. A reversible pump generates and delivers the air current to said apertures through a plurality of separate conduits connected to each of the apertures. A spreading device, which spreads, cuts, and stacks individual layers of fabric is provided with a plurality of air jets for selectively applying a thin film of air over the top of the fabric layers as they are spread. While the stack is being formed, the pump draws air through the fabric stack and down through the work table surface to hold the stack in place. When the stack is completed the pump is reversed so that a positive air pressure creates a cushion of air between the stack of fabric and the work table to move the stacked material to the cutting station. When the stack has reached the cutting station, the pump is again reversed, drawing air down through the fabric stack to hold the stack in place during the work process.

12 Claims, 3 Drawing Figures

SHEET MATERIAL STACKING, CONVEYING AND CUTTING METHOD AND APPARATUS

BACKGROUND

This application is related to those types of apparatus used in the conveying and cutting of sheet material, particularly fabric and other porous sheet material. The conventional method and apparatus for spreading and cutting multiple sheets of fabric has been to spread the sheets of fabric (as many as 300 plies) on a work table, stacking the sheets layer upon layer until the desired number of plies or sheets makes up the stack. When the stack is complete it is moved manually (generally by sliding) to a cutting station which is likely another area along the same work table. The spreading and stacking may be done manually or by spreading machines specially designed to spread, selectively cut, and stack the sheet layers. The movement of the stack, however, has traditionally been a completely manual procedure wherein several workmen, the number dependent upon the weight of the fabric stack, grip the sides of the stack and drag it to the cutting area. At the cutting area, the cutter operator must hold down the area of the stack immediately adjacent that which he is cutting to improve the quality and accuracy of the cut. Efforts to make the aforesaid process more efficient have generally been concentrated in the areas of the spreading apparatus and the cutting apparatus. Very little success has been obtained in the means for moving the fabric from one work station to another or in holding of the fabric in position during stacking and/or cutting.

While other industries have utilized air currents or air cushions for movement of heavy sheets of material into position, very little effort has been expended in utilizing the equipment which generates the air cushion to improving the spreading and cutting operations on fabric materials. Two U.S. patents, U.S. Pat. Nos. 3,670,612 and 3,253,756 are illustrative of approaches to using air cushions in the handling of sheet material. U.S. Pat. No. 3,253,756 is directed to a method and apparatus for conveying, scoring, and cutting sheets of glass. As such there is disclosed an air cushion for moving the glass from one work station to another work station. At the scoring and cutting station, the sheets of glass are held in place by cutting off the positive flow of air to eliminate the air cushion. After the air supply is shut off, the table top frictionally holds the glass sheet in position while a plurality of vacuum cups engage the upper surface of the glass sheet to further aid in holding it in place. The Johnson patent, U.S. Pat. No. 3,670,612, is directed to a card cutting apparatus wherein a single web or sheet of material is held in place by vacuum during a die cutting operation. After the cutting is completed the vacuum is released and air under a positive pressure is supplied to the work station to divert scrap material from between the cards into a waste receptacle and also to release the cards onto a conveyor for stacking.

Such air table apparatus has not been successful for use in the clothing manufacturing industry because the air pressure in such devices has generally been insufficient for moving heavy stacks of fabric from one work station to another. Further, the creation of a vacuum on the underside of a non-porous workpiece is not the same concept as drawing air through a plurality of porous sheets in a stack for holding large stacks of fabric securely in place during a cutting operation. Prior attempts to utilize suction for holding fabric stacks in place for cutting, such as those shown in U.S. Pat. No. 3,598,006, have involved the use of a vacuum chamber or manifold beneath the fabric guides, and other such elements for holding the fabric in alignment, in conjunction with an overlying sheet of air impervious material to aid in the creation of a vaccum to hold the fabric in place. Such apparatus is quite expensive to manufacture and the use of an overlying sheet or film creates problems with operators being able to follow a pattern unless the pattern is placed on top of the film material. If a pattern is placed on top of the film material, then the cutting knife must cut through the film, meaning that the film must be replaced with every cutting operation. If the pattern is printed on the film it creates further expense in pattern production.

SUMMARY OF THE PRESENT INVENTION

The present invention is directed to a substantially improved and unique method and apparatus for use in conjunction with the spreading and stacking of individual sheets of fabric material prior to a cutting operation. Although the table has been primarily designed for use in the stacking and cutting of fabrics, the table alone has many other potential uses in other industries. The apparatus facilitates the handling of goods or materials during processes such as cutting, sewing, binding or stacking, on any other work operation where sheet materials may be selectively held in place at one work station, then lightened by a film of air to be conveyed to another work station, and again held in place at a second work station. The work table itself has a top with a flat, substantially smooth upper surface on which the goods are processed. The top includes a plurality of apertures or air ports extending therethrough for passage of air currents. A reversible pump generates the positive or negative air current which is delivered to the apertures by means of a plurality of individual conduits, each of which separately connects one of said apertures to the source of air. Under a positive flow air current the goods float or ride on a cushion of air from one work station to a second work station. At the individual work stations, after the goods are properly positioned, the air current is reversed to a negative pressure to create suction through the apertures. The unique design of the air delivery system includes an increased number of apertures through the surface of the table, and individual conduits leading from the air generating source to the individual apertures, all of which combine to increase the suction force on the work piece(s). Thus a large stack of fabric sheets can be held securely in position without the use of edge guides or track means, and without use of air impervious sheets overlying the stack of material. The air suction has proven to be so strong that also it is no longer necessary for the operator to hold a particular area of fabric down while the cutting blade is working in that area. This factor significantly increases the safety of the cutting operation.

The basic spreading and stacking device which may be used in conjunction with the table is of a known type which, through reciprocating movement, spreads and stacks layers of fabric material. Also, the stacking may be carried on manually. A further unique feature of the present invention, when an automated spreader and stacker is used, lies in the addition of air jets which deposit a relatively soft current of air over the top of the fabric being stacked. The current of air smooths wrinkles and therefore increases the uniformity of the stack. As with the separate air supply to the table, the air jets on the spreading and stacking device may be selectively activated at any point in the stacking operation. For example, with very lightweight materials such as silks, jerseys, etc. operators may choose not to use the air jets until several layers of material have been stacked because the lighter fabrics are easily blown out of position. Even in some of the heavier weight materials, the air jets may not be turned on until four or five layers of material have been stacked.

Additionally, it may not be until after four or five layers have been spread and stacked that the air supply to the table is switched to a negative pressure to prevent shifting of the fabric stack as it is formed. The suction action from beneath the stack of fabric, combined with the soft air current over the top surface of the fabric stack, substantially eliminates the "bowing" or "sagging" effect frequently found in stacking fabrics. As a result of this "bowing" effect some fabrics may be thirty- to thirty-five percent higher on the edges of the stack than in the center which may result in misalignments or faulty cuts. Thus, the cooperating air currents significantly improve the uniformity and quality of the stacked material before it is moved to the cutting operation.

It is therefore an object of the present invention to provide an improved air table for the processing of stacks of fabric material. A further object of the invention is to provide a table of the type described in which the fabric is supported by means of an air cushion as it is moved from one work station to another, and the fabric is held in place at successive work stations by reversing the air flow and creating a negative pressure suction effect. A still further object of the invention is the provision of a spreading and stacking device which generates soft air currents over the top of successive layers to smooth wrinkles and improve the uniformity of the stack of material. Other objectives include the provision of apparatus which improves the safety of fabric cutting operations, and also which promotes economy and efficiency in the clothing manufacturing industry.

Other and further objects of the invention will become apparent to those skilled in the art as the following detailed description is studied in conjunction with the accompanying drawings, of which:

DETAILED DESCRIPTION OF A PREFERRED EMBODIMENT

Figure 1:
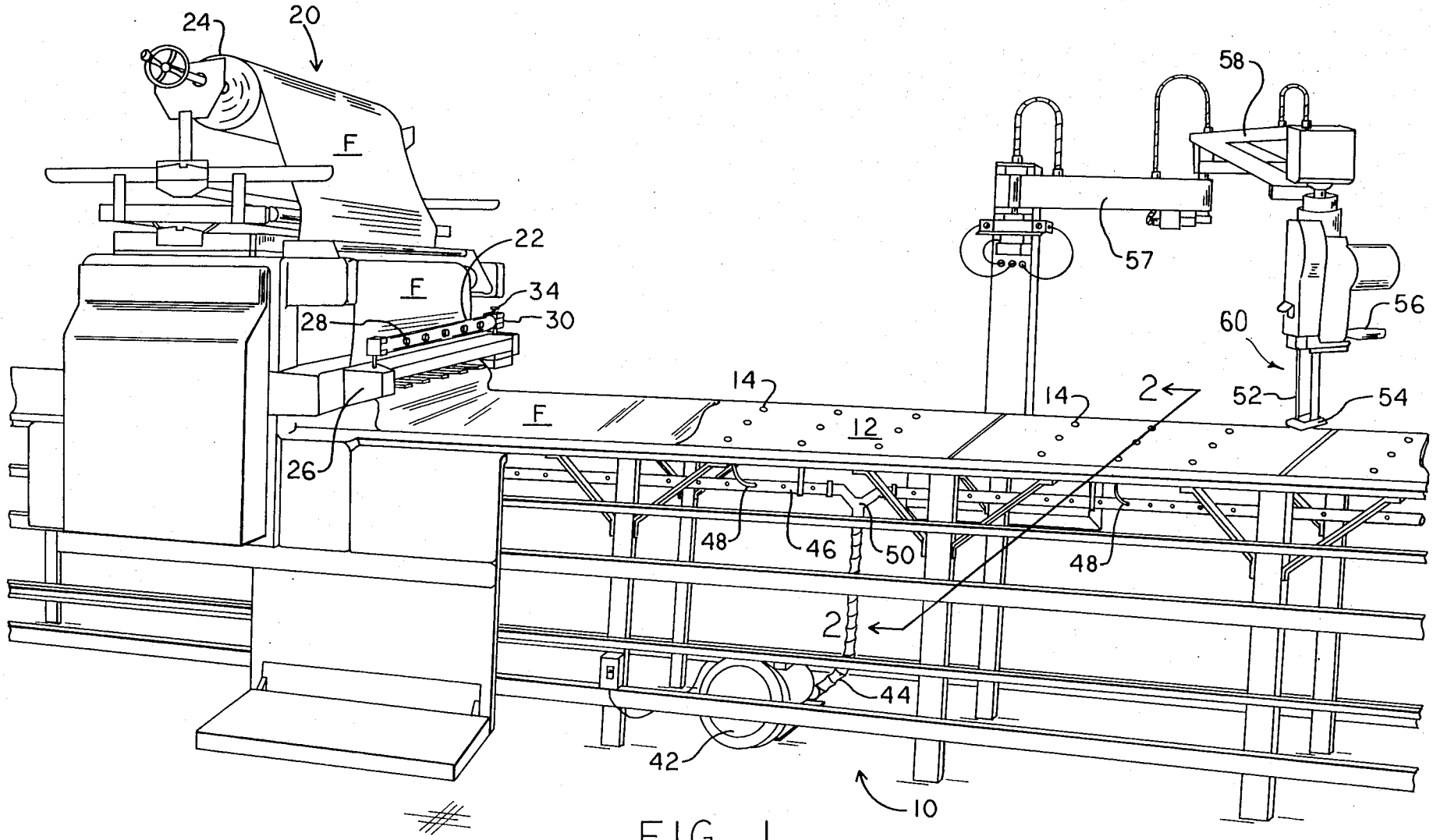
FIG. 1 is a perspective view of the work table according to the present invention and also illustrating associated spreading, stacking, and cutting devices utilized therewith.
Figure 2:
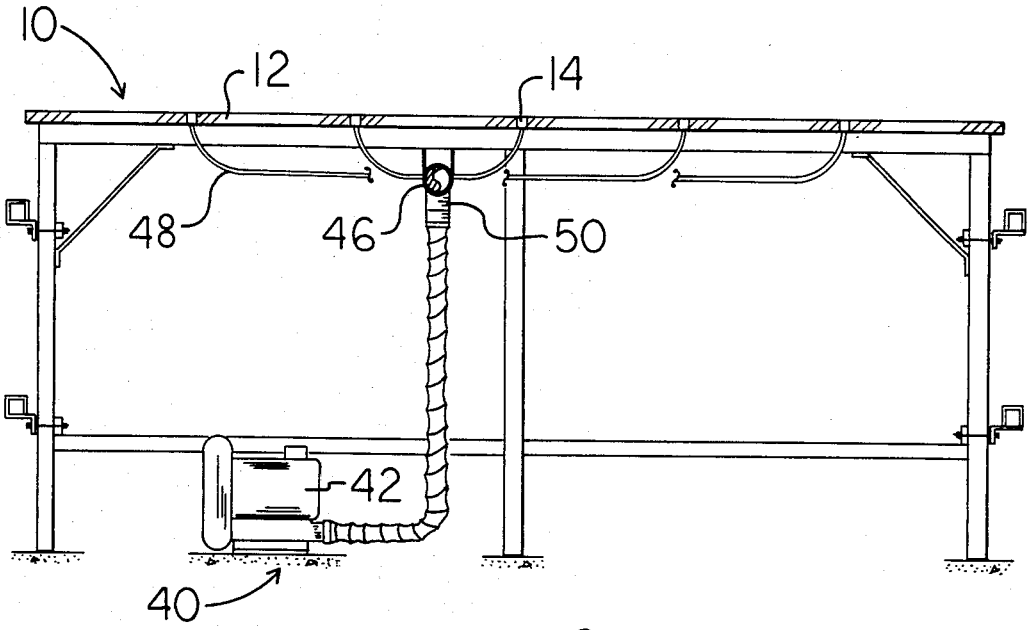
FIG. 2 is a cross-sectional view taken along lines 2—2 of FIG. 1, illustrating the relationship of the air generating device and air delivery conduits.
Figure 3:
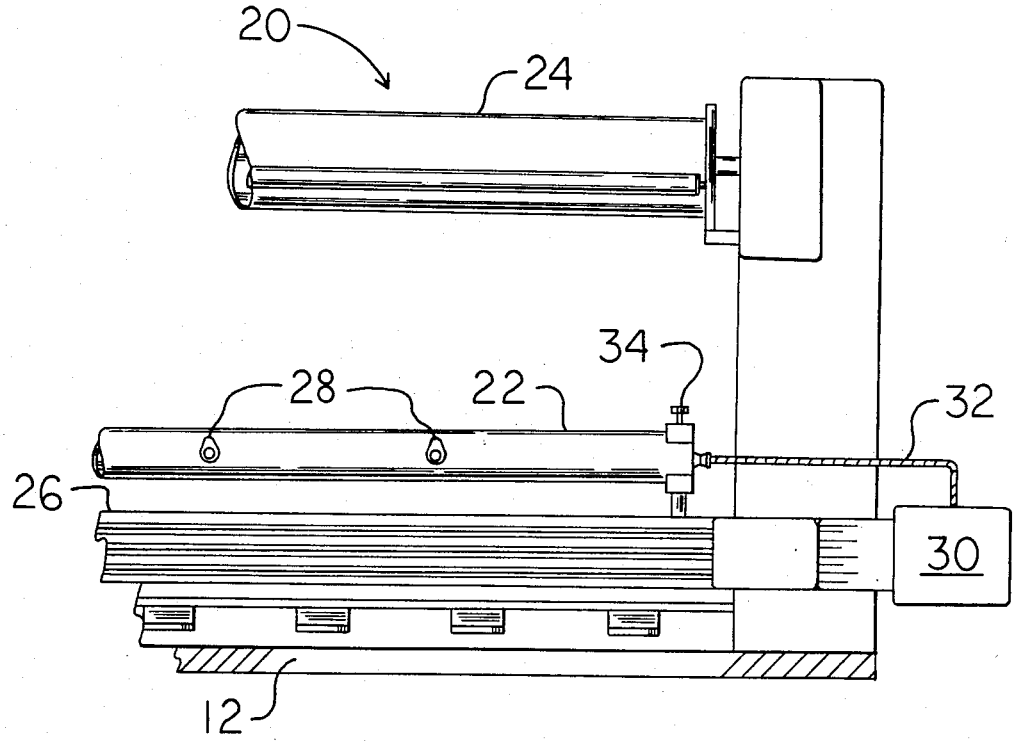
FIG. 3 is an enlarged front view of the spreading and stacking device of FIG. 1 showing details of the air jets thereon.

Looking first at FIG. 1, the apparatus for which the present invention was developed includes a work table 10 combined with a spreading and stacking device 20 and a cutting apparatus 60. The table itself includes a relatively smooth top surface 12 having a plurality of apertures 14 therethrough. Table 10 may be constructed as one continuous unit, but for ease in handling and adaptability for various work environments, it is preferably fabricated in segments, each approximately four feet in length. The segments are joined together by brackets or other joining means so that the operation and appearance is that of a continuous, undivided table. Air is supplied to the apertures 14 by means of one or more air generating devices 40.

Air generating device 40 includes a reversible pump 42 having a length of flexible hose 44 coupled thereto for delivering air to a common header 46 running longitudinally beneath top surface 12. A plurality of individual flexible conduits 48 are connected to the header and provide communication from the source of air to each aperture 14. The flexible hose 44 is connected to the header 46 by means of a coupling device 50 which may be either T-shaped or Y-shaped. The Y-shape is preferred for the coupling device 50 because it promotes a smoother air flow with less back pressure than does a similar T-shaped coupling device. The pump 42 is, in a preferred embodiment, a two and one-half horsepower, 220 V, 60 cycle, three-phase reversible pump capable of generating approximately 100 cfm, i.e. 90 inches of water. The air generated is delivered to the flexible hose 44 which is preferably one and one-half inches in diameter and approximately forty-inches in length. Hose 44 is coupled to a one and one-half inch diameter common header 46 as previously described. The common header feeds a plurality of conduits 48 formed of flexible hose. The end of each conduit opposite header 46 is coupled to the undersurface of the top 12, extending into the apertures such that the air exits apertures 14. Each of the apertures 14 is approximately one-eighth inch in diameter, and the apertures are spaced twelve inches apart. As shown in the preferred embodiment, apertures 14 are aligned in three spaced rows per each four-foot segment of table. The rows are approximately twelve inches apart, the apertures 14 within the rows are approximately twelve inches apart. This is the preferred pattern but other patterns and arrangements of apertures might be used and selected according to the operation being performed.

As previously described, the air current supplied to the table during movement of the stack of fabric or material from one work station to another work station is a positive pressure air flow which creates a cushion of air between the surface of the table and the stack of fabric F. The air current is reversed from a positive to negative pressure to apply suction to the stack of fabric after it has reached the selected work station. Due to the air cushion created by the positive pressure flow, the stack of fabric can be moved from one work station to another by one to two operators. In previous operations, the movement of such stacks of fabric required many people. The weight of the stack of fabric which may have as many as ninety to three hundred plies is considerable (75–400 pounds) and in the past has required numerous operators to lift and carry the stack of fabric from one work station to another. But as disclosed, the air cushion formed by the positive pressure flow eliminates the necessity for more than one or two operators to merely guide the stack of fabric into position at the next work station.

At each work station when the air current is reversed and the suction is applied, the passage of air through the stack of fabric holds each layer of the stack quite securely in place without additional operator involvement. Because of this fact a cutter can spend his time and attention in directing the cutting blade around the outline of the pattern without using his free hand to hold the fabric down. Holding the fabric down as the blade is cutting nearby has in the past created a dangerous condition leading to many injuries.

The spreading and stacking apparatus 20 is of a known type which reciprocates longitudinally along the table to spread, cut and stack individual plies of fabric. According to the present invention the stacker further includes a manifold 22 for supplying a current of air to the upper or top surface of the stack of fabric for the purpose of smoothing wrinkles and thus aiding in construction of a uniform stack of material. The manifold 22 is mounted along the leading face of the spreader at a point in front of the fabric as it descends from the supply roll 24. As can be seen in FIG. 1 the fabric F is threaded through the spreader and stacker from supply roll 24 to a point that it is spread on the upper surface of the table 12. The air manifold 22 is mounted on one of the forward cross beams 26 with the air jets 28 in the manifold directed downwardly and forwardly onto the stack of fabric. The plurality of air jets 28 are spaced individually along the leading side of the air manifold 22. Air is supplied to the manifold from a fan or other air generating means mounted in a box 30 to one side of cross beam 26. The air created by the fan is fed through conduit 32 to the air manifold and exits the jets 28 to the fabric at approximately 20 psi. Control of the air supply to the jets is manually by valve 34 positioned approximately at the juncture of conduit 32 and manifold 22. When it is desired to cut the air supply off, the valve 34 is closed. The air is continuously applied from the air jet 28 in a relatively gentle current measuring approximately twenty psi. For lightweight fabrics, as previously disclosed, it may be desirable to eliminate the air current until four or five layers of fabric have been stacked. Otherwise the application of the air current may blow the fabric out of position rather than increasing the efficiency of stacking.

The cutting mechanism 60 is of a relatively conventional nature having a vertical blade 52 and a foot plate 54 which moves along the surface of the fabric during the cutting operation. The operator guides the cutting blade 52 by means of handle 56. The support arms 57 and 58 are pivotally mounted so that the cutting assembly can be moved anywhere along the surface of the fabric or table. It is important that the foot plate 54 be of a relatively small size, preferably two inches by three inches so that it does not interfere with the air suction applied by the apertures 14.

The process of spreading and cutting fabric is generally as follows: (1) through reciprocating motion of stacker 20, spreading a desired length of fabric F on the smooth upper surface 12 of the table; (2) by continued reciprocating movement, spreading second and third layers of fabric F on top of the first layer; (3) at some point soon after stacking commences (3 or 4 layers) activating pump 42 in a reverse direction to clamp the stack of workpieces to the table top 12; (4) applying air to the upper surface of selected layers through jets 28 for the purpose of spreading and smoothing the fabric; (5) after the stack is built to a prescribed number of layers, reversing the negative air flow to a positive air current to form a cushion of air between the top of the table and the bottom of the stack of fabric, and moving said fabric to a second work station; (6) once the fabric is in position at the work station, again reversing the air current through apertures 14 to create a negative suction effect on the stack of fabric; (7) cutting the fabric according to a desired pattern; (8) reversing the air current again to create a positive pressure air cushion for moving the stack of cut material to a subsequent work operation. Depending on the fabric weight and characteristics, the air jets 28 may or may not be required. Further, it is sometimes helpful to periodically reverse the air flow through apertures 14 during the formation of the fabric stack to relieve the pressure on the stack and aid in the removal of wrinkles.

It is obvious that while one stack of fabric is being cut, another stack of fabric can be formed by the spreader and stacker 20. In such situations it is generally helpful if the air supply to the lay-up work station is separate from the air supply for the cutting station. The air supply through apertures 14 is totally separate from that supplied through air jets 28. It has been found that the air supply from jets 28 which smooths the wrinkles, when applied simultaneously with a suction effect through apertures 14 is quite effective in the construction of a uniformly stacked and aligned group of fabric pieces.

More complete details of the components of the spreading and stacking apparatus and the cutting apparatus have not been included because they are generally of a conventional construction and are not critical to the present invention. One spreading machine that is used with the spreading table is the Kuris-Pionier, sold by Krauss u. Reichert of Stuttgart, West Germany. However, a variety of stacking and cutting machines of this type would be acceptable. The air manifold 22 and the air table 10 would be adaptable and operative with a variety of known spreaders and cutters. Additionally, while the stacking and cutting of fabric plies has been described herein, it is obvious that the air table functions for a variety of work operations. It has been found that the suction effect for holding work objects in a position is far stronger with the present invention than has previously been achieved. Thus it is quite adaptable to a number of industries such as glass, paper, and mattress making, with few or no more modifications. Additionally, other and further modifications might be made to the previously described apparatus without departing from the scope of the claims below.

What is claimed is:

1. An apparatus for facilitating the handling of goods or materials during processes such as cutting, sewing, binding, stacking and the like where the goods or materials are conveyed from one work station to another work station by means of a cushion of air, and then held in place at a selected work station by application of air suction, said apparatus comprising:

(a) a work table having a top with a flat, substantially smooth upper surface on which the goods are processed;

(b) a plurality of apertures arranged in spaced relationship to each other in a selected pattern covering a substantial portion of said top, and extending through said top for passage of air currents therethrough;

(c) means for generating and delivering said air currents to said apertures, said means comprising an air current generator and a plurality of conduits operatively connected thereto, each one of said conduits being separately connected to one of said apertures and collectively connected by means of a header having a substantially lesser volume than the volume of said table bounded by said apertures to said generating source for delivering air from said generator to said apertures;

(d) means for relatively instantaneously reversing said air current from a positive flow pressure to a negative flow pressure;

whereby the substantially lesser header volume allows for the relatively instantaneously application of said reversing air current such that the goods on which work is being performed are subjected to the selective and instantaneous application of a positive pressure air current for forming said cushion of air to convey the goods, or to a negative pressure air current for applying suction pressure to hold the goods in place; thus eliminating the necessity of additional guides, apparatus or holding mechanisms for stabilizing the goods.

2. An apparatus according to claim 1 wherein said air generating source comprises a pump having selected output and voltage characteristics.

3. Apparatus according to claim 2 wherein said means for reversing said air currents comprises: said pump having a power source including a three-phase motor associated therewith, and said motor including a switch means for reversing the polarity of said motor; said switch means being movable between a first position wherein said air current is under a positive pressure, and a second position wherein said air current is under negative pressure.

4. An apparatus according to claim 1 wherein said means for connecting said header and said air generating source comprises a selected length of flexible hose having one end connected to an outlet port on said generating source and the opposite end having coupling means for connecting said hose to said header.

5. Apparatus according to claim 4 wherein said coupling means comprises a Y-shaped connector.

6. An apparatus for laying out and cutting a plurality of stacked sheets of fabric material wherein said stack is conveyed between a plurality of work stations, including a first lay-out station, by means of a cushion of air, and wherein said stack is held in place at a selected work station by means of air suction; said apparatus comprising:

(a) a work table having a top with a flat, substantially smooth upper surface on which the fabric sheets are conveyed;

(b) a plurality of apertures arranged in spaced relationship to each other in a selected pattern covering a substantial portion of said top, and extending through said top for passage of air currents therethrough;

(c) means for generating and delivering said air currents to said apertures comprising an air generating source and a plurality of conduits operatively connected thereto, each one of said conduits separately connecting one of said apertures by means of a header having substantially lesser volume than the volume of said table bounded by said apertures to said generating source;

(d) means for relatively instantaneously reversing said air currents from a positive flow pressure to a negative flow pressure;

(e) a spreading device for laying out and stacking layers of sheet fabric material, said spreading device including air supply means for selectively applying a positive pressure film of air over the top of the fabric layers to smooth out wrinkles in the layers of fabric;

whereby as the fabric layers are spread and stacked on said table, said film of air is selectively applied from above said stack to smooth the layers as air suction is selectively and simultaneously applied through said apertures in said table to the underside of the stack to hold the stack in place; and when the stack is completed the negative pressure air suction through said apertures is reversed to a positive pressure flow to form said air cushion on which the stack of fabric is conveyed to the next work station.

7. An apparatus according to claim 6 wherein said air supply means includes:

(a) a manifold mounted across the front side of said spreading device, said manifold including a plurality of horizontally spaced, air jets therein for supplying said film of air over the fabric layers;

(b) said air supply means connected to said manifold for generating an air flow through said air jets; and (c) valve means for controlling the flow of air through said air jets.

8. An apparatus according to claim 6 wherein said air generating source comprises an electric pump.

9. An apparatus according to claim 8 wherein said means for connecting said header and said air generating source comprises a length of flexible hose having one end of said hose connected to an outlet port on said generating source and the opposite end including coupling means for connecting said hose to said header.

10. Apparatus according to claim 9 wherein said coupling means comprises a Y-shaped connector.

11. A method of laying out and cutting multiple plies of porous sheet material comprising the steps of:

(a) spreading the individual sheets of material on the surface of a work table which is divided into multiple work stations and having a plurality of apertures therein for passage of a selected positive or negative pressure air current therethrough;

(b) selectively applying suction through said apertures after the stack has reached a predetermined number of plies and through the sheets of said stack to hold the stack in position until completed;

(c) reversing said suction current to a positive pressure current through said apertures to form a cushion of air between said stack of sheet material and said work table surface, and conveying said stack of fabric on said air cushion to a cutting station spaced a distance away from the spreading station on said work table;

(d) reversing said positive air current to a negative air current to again create suction through said apertures and through said fabric stack to again hold said stack of fabric in place during the cutting operation.

12. The method according to claim 11 and further including in selected layers the step of applying a thin film of air over the upper surface of said sheets to smooth wrinkles.

* * * * *